US008261904B2

(12) United States Patent
Nakazumi et al.

(10) Patent No.: US 8,261,904 B2
(45) Date of Patent: Sep. 11, 2012

(54) COIN DEPOSITING AND DISPENSING MACHINE

(75) Inventors: Keisuke Nakazumi, Himeji (JP); Eisei Nishida, Himeji (JP); Takushi Ohno, Himeji (JP); Masashi Ito, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 99 days.

(21) Appl. No.: 12/525,382

(22) PCT Filed: Feb. 1, 2007

(86) PCT No.: PCT/JP2007/051670

§ 371 (c)(1),
(2), (4) Date: Jul. 31, 2009

(87) PCT Pub. No.: WO2008/093420

PCT Pub. Date: Aug. 7, 2008

(65) Prior Publication Data

US 2010/0062700 A1 Mar. 11, 2010

(51) Int. Cl.
*G07D 3/14* (2006.01)
*G07D 5/00* (2006.01)

(52) U.S. Cl. ..... 194/346; 194/344

(58) Field of Classification Search ..... 194/346, 194/200, 342, 344, 347, 350; 235/379; 453/3, 453/7, 11, 33, 34, 35
See application file for complete search history.

(56) References Cited

U.S. PATENT DOCUMENTS 4,635,661 A * 1/1987 Uematsu et al. ..... 194/217
4,758,201 A * 7/1988 Ozeki ..... 453/56
5,135,433 A * 8/1992 Watanabe et al. ..... 453/3
5,232,398 A * 8/1993 Maki ..... 453/57
5,899,804 A * 5/1999 Chiba et al. ..... 453/11
6,176,774 B1 * 1/2001 Filiberti et al. ..... 453/32

(Continued)

FOREIGN PATENT DOCUMENTS

EP 1 734 489 A2 12/2006

(Continued)

OTHER PUBLICATIONS

Supplementary European Search Report (dated May 7, 2010—7 pages).

(Continued)

*Primary Examiner* — Mark Beauchaine
(74) *Attorney, Agent, or Firm* — Renner, Kenner, Greive, Bobak, Taylor & Weber

(57) ABSTRACT

A coin depositing and dispensing machine prevents a foreign object mixed together with coins put in a coin receiving port from causing a malfunction, facilitates distinguishing coins of a depositing and transporting system from coins of a dispensing and transporting system, and facilitates removal of a coin jam. Coins received from a coin receiving port are fed separately by a feeding unit to a depositing and transporting unit. A rotary disc rotated at a position tilted at a predetermined angle is used for the feeding unit. By using the rotary disc, only coins are fed to the depositing and transporting unit, and foreign objects are eliminated. The depositing and transporting unit and a dispensing and transporting unit are arranged opposite to each other in a machine body, and the depositing and transporting unit is tilted together with the rotary disc. Coins in each unit are thereby easily distinguished from each other.

12 Claims, 14 Drawing Sheets

U.S. PATENT DOCUMENTS

| | | | | |
|---|---|---|---|---|
| 6,264,545 | B1 * | 7/2001 | Magee et al. | 453/3 |
| 7,066,807 | B2 * | 6/2006 | Abe et al. | 453/7 |
| 2003/0201146 | A1 | 10/2003 | Abe et al. | |

FOREIGN PATENT DOCUMENTS

| | | | |
|---|---|---|---|
| JP | 52-85893 | A | 7/1977 |
| JP | 54-2080 | U | 1/1979 |
| JP | 57-92260 | U | 6/1982 |
| JP | 61-29990 | A | 2/1986 |
| JP | 61-237187 | A | 10/1986 |
| JP | 62-6396 | A | 1/1987 |
| JP | 07-282317 | A | 10/1995 |
| JP | 07-296217 | A | 11/1995 |
| JP | 2000-076517 | A | 3/2000 |
| JP | 2000-132714 | | 5/2000 |
| JP | 2001-155206 | A | 6/2001 |
| JP | 2003-162749 | | 6/2003 |
| JP | 2005-141577 | | 6/2005 |
| JP | 2006-309467 | A | 11/2006 |

OTHER PUBLICATIONS

Office Action issued for corresponding European Patent Application No. 07 707 856.6 (5 pages—dated Jun. 28, 2011).

* cited by examiner

COIN DEPOSITING AND DISPENSING MACHINE

CROSS-REFERENCE TO PRIOR APPLICATION

This is the U.S. National Phase Application under 35 U.S.C. §371 of International Patent Application No. PCT/JP2007/051670 filed Feb. 1, 2007, which is incorporated by reference herein. The International Application was published in Japanese on Aug. 7, 2008 as WO 2008/093420 A1 under PCT Article 21(2).

FIELD OF THE INVENTION

The present invention relates to a coin depositing and dispensing machine enabling depositing and dispensing of coins.

BACKGROUND OF THE INVENTION

Conventionally, a coin depositing and dispensing machine, such as an automatic change dispenser, which is electrically connected to a POS cash register and enables automatic depositing and dispensing of coins, has been developed for accurately and promptly receiving and delivering cash from and to customers in, for example, a shop.

In such a coin depositing and dispensing machine, a coin receiving port for receiving coins is formed on the right side of an upper face of a machine body, and a coin ejecting port for ejecting coins is formed on the left side of a front face of the machine body.

A feeding belt for feeding coins one by one is disposed at the bottom of the coin receiving port, and a depositing and transporting system is provided continuously to the feeding belt, the system transporting coins along a front face of the machine body and sorting coins for each denomination. Denomination-specific coin accommodating and ejecting portions are juxtaposed along the front face of the machine body under the depositing and transporting system and behind the coin ejecting port, the portion accommodating the coins sorted for each denomination by the depositing and transporting system in depositing, and ejecting accommodated coins one by one to the coin ejecting port in dispensing (see, for example, Japanese Laid-Open Patent Publication No. 7-282317, pp. 2-3, FIGS. 1-11), which is hereby incorporated by reference herein in its entirety).

Additionally, there exists a coin depositing and dispensing machine in which a depositing and transporting system for transporting coins along a right side face of a machine body is provided continuously to a feeding belt, denomination-specific coin accommodating and ejecting portions are successively juxtaposed from the front side to the rear side of the machine body and a dispensing and transporting system for transporting coins ejected from the denomination-specific coin accommodating and ejecting portions to a coin ejecting port is provided along a left side face of the machine body (see, for example, Japanese Laid-Open Patent Publication No. 2006-309467 (pp. 3-5, FIGS. 1-4), which is hereby incorporated by reference in its entirety.)

SUMMARY OF THE INVENTION

As described above, in conventional coin depositing and dispensing machines, coins put into a coin receiving port are received by a feeding belt, and fed one by one by rotation of the feeding belt. However, in the case where a foreign object is here mixed with the coins, the foreign object is simultaneously fed and causes a malfunction to a depositing and transporting system, coin accommodating and ejecting portion, dispensing and transporting system or the like.

Additionally, since the depositing and transporting system and dispensing and transporting system are generally arranged adjacent to each other, coins to be managed in the machine are hardly distinguished from coins to be managed out side the machine. Management of coins in processing cannot be exactly distinguished, in the case where a coin jam arises in the machine.

The present invention has been developed in view of the above problems, and aims to provide a coin depositing and dispensing machine which can prevent a foreign object mixed with coins put in the coin receiving port from causing a malfunction, facilitate distinction of coins of the depositing and transporting system and coins of the dispensing and transporting system, and facilitate removal of a coin jam. Management of coins in processing can be exactly distinguished in the case where a coin jam arises.

A coin depositing and dispensing machine according to embodiment of the present invention includes: a coin receiving port for receiving coins from the outside of a machine body of the coin depositing and dispensing machine; a coin ejecting port for ejecting coins outward from the inside of the machine body: a feeding unit which includes a rotary disc rotated, around a rotary axis attached to the machine body, at a position tilted at a predetermined angle in relation to a horizontal direction and a hopper for accommodating coins, which are received from the coin receiving port, on a surface side of the rotary disc with the coins not aligned, and can feed the coins, which are received from the coin receiving port, one by one; a depositing and transporting unit which includes depositing and transporting pulleys each rotated, around the rotary axis attached to the machine body, at a position tilted at a predetermined angle in relation to the horizontal direction, and an endless depositing and transporting body supported by the depositing and transporting pulleys so as to extend along one side of the machine body and having projections capable of pushing and transporting coins one by one, and transports the coins fed from the feeding unit; a recognition unit for at least recognizing denominations of coins transported by the depositing and transporting unit; a plurality of coin accommodating and ejecting portions which are successively disposed from the front side to the rear side of the machine body, and can accommodate coins, which are sorted for each denomination in accordance with a recognition result by the recognition unit, for each denomination and eject the accommodated coins to an other side face of the machine body; sorting units which, by electric driving, in accordance with the recognition result by the recognition unit, discharge coins, which are transported by the depositing and transporting unit and cannot be accepted in the machine body, outward from the machine body, and sort coins, which are transported by the depositing and transporting unit and can be accepted in the machine body, into the plurality of coin accommodating and ejecting portions for each denomination; a reject return port disposed on a front face of the machine body, and for returning coins which are to be discharged outward from the machine body by the sorting units and cannot be accepted in the machine body; and a dispensing and transporting unit which faces the depositing and transporting unit, extends along the other side face of the machine body, and transports coins ejected from the coin accommodating and ejecting portions to the coin ejecting port.

Since a rotary disc rotated at a position tilted at a predetermined angle in relation to a horizontal direction is used for a feeding unit for feeding coins, one by one, received from a coin receiving port to a depositing and transporting unit, only coins are fed to the depositing and transporting unit, a foreign object mixed with the coins is not fed and a malfunction due to the foreign object can be prevented. Additionally, since the depositing and transporting unit and a dispensing and transporting unit are arranged opposite to each other in a machine body and the depositing and transporting system is tilted with the tilted rotary disc, coins of the depositing and transporting system and coins of the dispensing and transporting system are easily distinguished from each other and management of coins in processing can be exactly distinguished in the case where a coin jam arises.

The dispensing and transporting unit preferably includes: dispensing and transporting pulleys pivotally supported in a horizontal direction in relation to the machine body and rotatable; an endless dispensing and transporting body which is supported by the dispensing and transporting pulleys and can receive and transport a plurality of coins; and dispensing passage walls surrounding a coin transporting face of the dispensing and transporting body from its both sides and above.

The coin depositing and dispensing machine in spite of its small size, has a large receiving capacity of coins and can handle transporting coins ejected from a plurality of coin accommodating ejecting portions, because the dispensing and transporting unit includes dispensing and transporting pulleys pivotally supported horizontally in relation to the machine body and rotatable, an endless dispensing and transporting body which is supported by the dispensing and transporting pulleys and capable of receiving and transporting a plurality of coins, and dispensing passage walls surrounding a coin transporting face of the dispensing and transporting body from its both sides and above.

At least the upper face of the dispensing passage wall is preferably transparent, and an interval between the upper face of the dispensing passage wall and the coin transporting face of the dispensing and transporting body is preferably smaller than the diameter of the smallest coin among coins to be handled by the coin depositing and dispensing machine.

Since an interval between the upper face of the dispensing passage wall and coin transporting face of the dispensing and transporting body is made smaller than the diameter of the smallest coin among coins to be handled by the coin depositing and dispensing machine, coins are prevented from being stood up between the upper face of the dispensing passage wall and coin transporting face of the dispensing and transporting body, and a coin jam and any remaining coins can be prevented; since at least the upper face of the dispensing passage wall is transparent, positions of coins can be easily specified even in the case where a coin jam or any remaining coins arise.

The upper face of the dispensing passage wall is preferably openable and closable.

A coin jam can be easily removed, because the upper face of the dispensing passage wall is openable and closable.

At least one openable and closable door is preferably provided in one of the two side surfaces of the dispensing passage wall and which is facing outward from the machine body.

A coin jam can be easily removed, because at least one openable and closable door is provided on one of the two side surfaces of the dispensing passage walls and which is facing outward from the machine body.

The coin depositing and dispensing machine preferably further includes: a coin discharge port which is disposed at the downstream side in a transporting direction of the dispensing and transporting unit and through which coins transported by the dispensing and transporting unit are discharged outward from the machine body; a switching gate for switching a transport destination of a coin transported by the dispensing and transporting unit to the coin ejecting port or coin discharge port; a full state detecting portion for detecting a full state of the coin accommodating and ejecting portion filled with coins; and a coin discharge controlling portion for switching a direction of the switching gate to a direction of guiding coins to the coin discharge port side, causing the coin accommodating and ejecting portion, which is detected to be in a full state, to eject the coins, and causing the dispensing and transporting unit to transport the coins, which are ejected from the coin accommodating and ejecting portion, to the coin discharge port in the case where the full state detecting portion detects, in the depositing operation, the coin accommodating and ejecting portion is filled with coins.

Processing can be continued without interruption of a depositing transaction even in the case where a full state detecting unit detects, in depositing operation, the coin accommodating and ejecting portion is filled with accommodated coins, because a direction of a switching gate is switched to a direction of guiding coins to a coin discharge port, the coins are ejected from the coin accommodating and ejecting portion in the detected full state, and the coins ejected from the coin accommodating and ejecting portion can be transported and collected to the coin discharge port by the dispensing and transporting unit.

A coin cassette is preferably attachably and detachably disposed under the coin discharge port and accommodates coins transported to the coin discharge port.

The coins ejected from the coin accommodating and ejecting portion in the full state can be accommodated or coins to be collected ejected from the coin accommodating and ejecting portion can be collected, because the coins transported to the coin discharge port are accommodated in a coin cassette attachably and detachably disposed under the coin discharge port.

A collection controlling portion preferably enables the coin ejecting port or coin discharge port to be selected as transport destinations of all coins in the coin accommodating and ejecting portion when the coins in the coin accommodating and ejecting portion are collected outside the machine body.

When all coins in the coin accommodating and ejecting portion are collected outside the machine body, either coin ejecting port or coin discharge port can be arbitrarily selected as a transport destination of the coin in the coin accommodating and ejecting portion.

The coin depositing and dispensing machine preferably further includes: a deposit starting button for starting depositing operation by push-down; and a deposit starting button push-down detecting unit for detecting push-down of the deposit starting button.

The depositing operation is not uncontrollably started in e.g. putting coins into the machine and can be started based on the will of an operator, because it is started by detection of push-down of a deposit starting button.

A deposit controlling portion preferably drives the feeding unit and depositing and transporting unit to start depositing operation in the case where push-down of the deposit starting button is detected by the deposit starting button push-down detecting unit.

The depositing operation is not uncontrollably started, because the feeding unit and depositing and transporting unit are driven and then the depositing operation is started in the case where the push-down of the deposit starting button is detected.

A temporary storage cover is preferably disposed between the coin receiving port and feeding unit, can be opened and closed by electric driving and can temporarily store coins received from the outside of the machine body in a closing state. A temporary storage cover controlling portion preferably opens the temporary storage cover and drops coins on the temporary storage cover onto the feeding unit in the case where push-down of the deposit starting button is detected by the deposit starting button push-down detecting unit. A deposit controlling portion preferably drives the feeding unit and depositing and transporting unit to start depositing operation in the case where push-down of the deposit starting button is detected by the deposit starting button push-down detecting unit.

The depositing operation is not uncontrollably started, because coins put in the outside of the machine body can be checked once by temporarily storing the coins on a closed temporary storage cover, and the temporary storage cover is opened, the coins thereon are dropped onto the feeding unit, the feeding unit and depositing and transporting unit are driven and then the depositing operation is started in the case where the push-down of the deposit starting button is detected.

The coin depositing and dispensing machine preferably further includes: a received coin detecting sensor which is disposed on the outer periphery of a lower opening, which is narrower and smaller than an upper opening, of the coin receiving port, and detects receipt of coins in the coin receiving port; and a deposit controlling portion which drives the feeding unit and depositing and transporting unit to start depositing operation in the case where the receipt of coins is detected by the received coin detecting sensor.

Since a lower opening of a coin receiving port is made narrower and smaller than an upper opening thereof, receipt of coins in the coin receiving port can be reliably detected by a received coin detecting sensor disposed on the outer periphery of the lower opening of the coin receiving port, and in the case where the receipt of coins is detected, the feeding unit and depositing and transporting unit are driven and then the depositing operation can be automatically started.

The coin depositing and dispensing machine also preferably includes: a coin receiving and accommodating port for receiving coins acceptable in the machine body; an accommodated coin ejection port for ejecting accommodated coins; accommodating and ejecting rollers pivotally supported horizontally in relation to the machine body and rotatable; an accommodating and ejecting belt which accommodates coins acceptable in the machine body with the coins not aligned, and is supported by the accommodating and ejecting rollers so as to be tilted upward from the upstream side to the downstream side in a transporting direction of coins; a reverse roller which is located above the accommodated coin ejection port side of the accommodating and ejecting belt, is rotated reversely to a transporting direction of the accommodating and ejecting belt, aligns the coins not aligned on the accommodating and ejecting belt in one layer and one line, and ejects the coins from the accommodated coin ejection port; an ejection controlling member for controlling ejection of coins to be ejected from the accommodated coin ejection port, one by one; and an ejected coin number detecting portion for detecting the number of coins ejected from the accommodated coin ejection port.

The coin accommodating and ejecting portion can receive and accommodate coins on an accommodating and ejecting belt with the coins not aligned and reliably eject the coins not aligned one by one.

BRIEF DESCRIPTION OF THE DRAWINGS

The present invention will become more readily apparent from the detailed description of the invention, which proceeds with reference to the drawings in which.

DETAILED DESCRIPTION OF THE INVENTION

Figure 1:
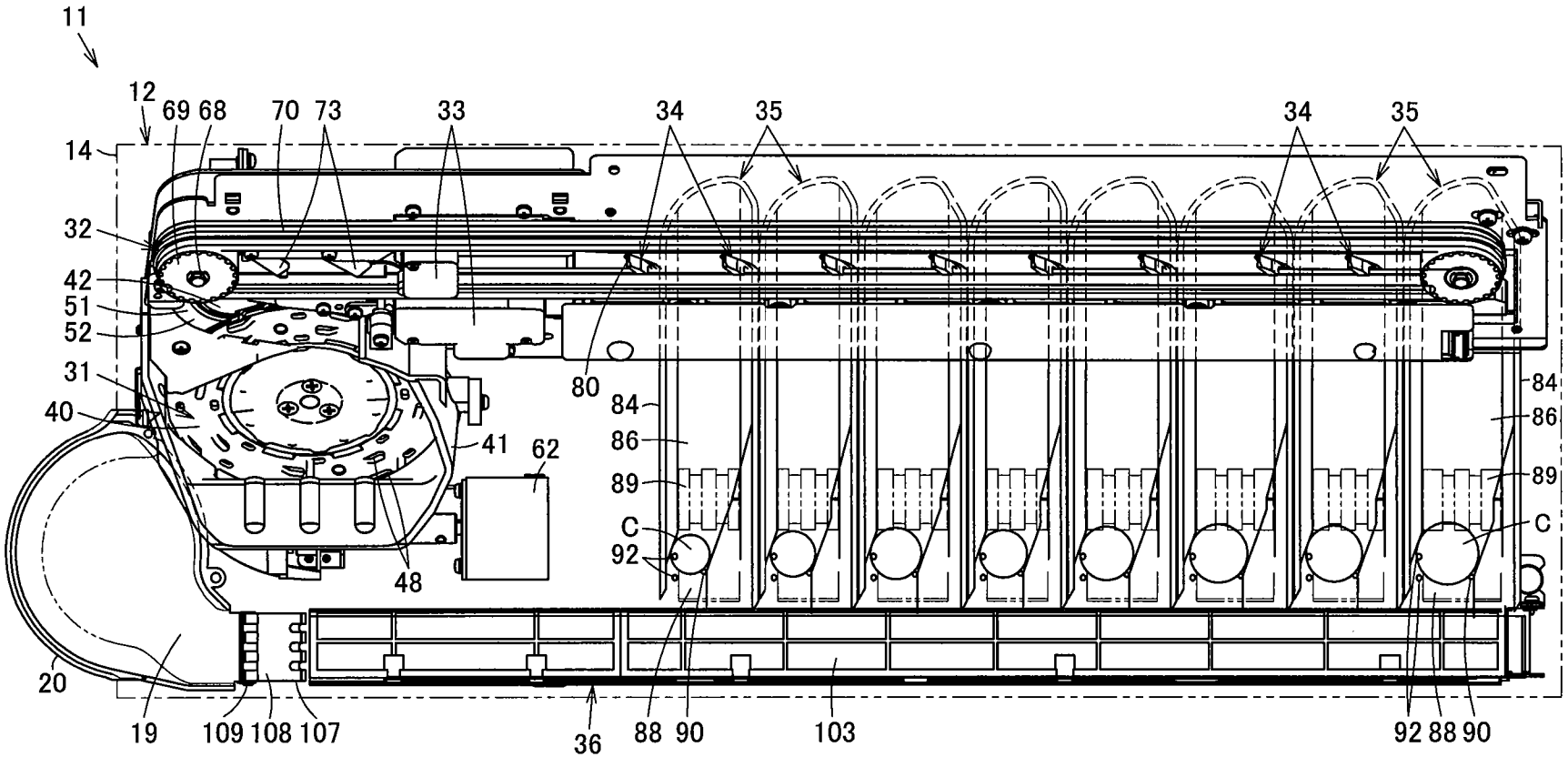
FIG. 1 is a top plan view showing an inner structure of a coin depositing and dispensing machine of a first embodiment of the present invention.

A listing of some of the reference numerals that are used in the drawings, together with descriptions of the corresponding elements, is provided below:

11 Coin depositing and dispensing machine
12 Machine body
16 Coin receiving port
18 Deposit starting button
19 Coin ejecting port
21 Reject return port
24 Coin cassette

31 Feeding unit
32 Depositing and transporting unit
33 Recognition unit
34 Sorting unit
35 Coin accommodating and ejecting portion
36 Dispensing and transporting unit
39 Rotary axis
40 Rotary disc
41 Hopper
68 Rotary axis
69 Depositing and transporting pulley
70 Depositing and transporting belt as depositing and transporting body
71 Projection
85 Coin receiving and accommodating port
86 Accommodating and ejecting belt
87 Accommodating and ejecting roller
88 Accommodated coin ejection port
89 Reverse roller
90 Ejection controlling member
92 Ejected coin number detecting portion
97 Dispensing and transporting belt as dispensing and transporting body
98 Dispensing and transporting pulley
100 Coin transporting face
101-103 Dispensing passage wall
104 Opening and closing door
107 Coin discharge port
108 Switching gate
122 Deposit starting button push-down detecting unit
126 Full state detecting portion
127 Coin discharge controlling portion
128 Collection controlling portion
129 Deposit controlling portion
131 Temporary storage cover
133 Temporary storage cover controlling portion
136 Received coin detecting sensor Hereinafter, embodiments of the present invention will be described with reference to the drawings. Moreover, each of the following embodiments is only cited as an example, and does not limit the scope of the present invention beyond that which is claimed.

Figure 13:
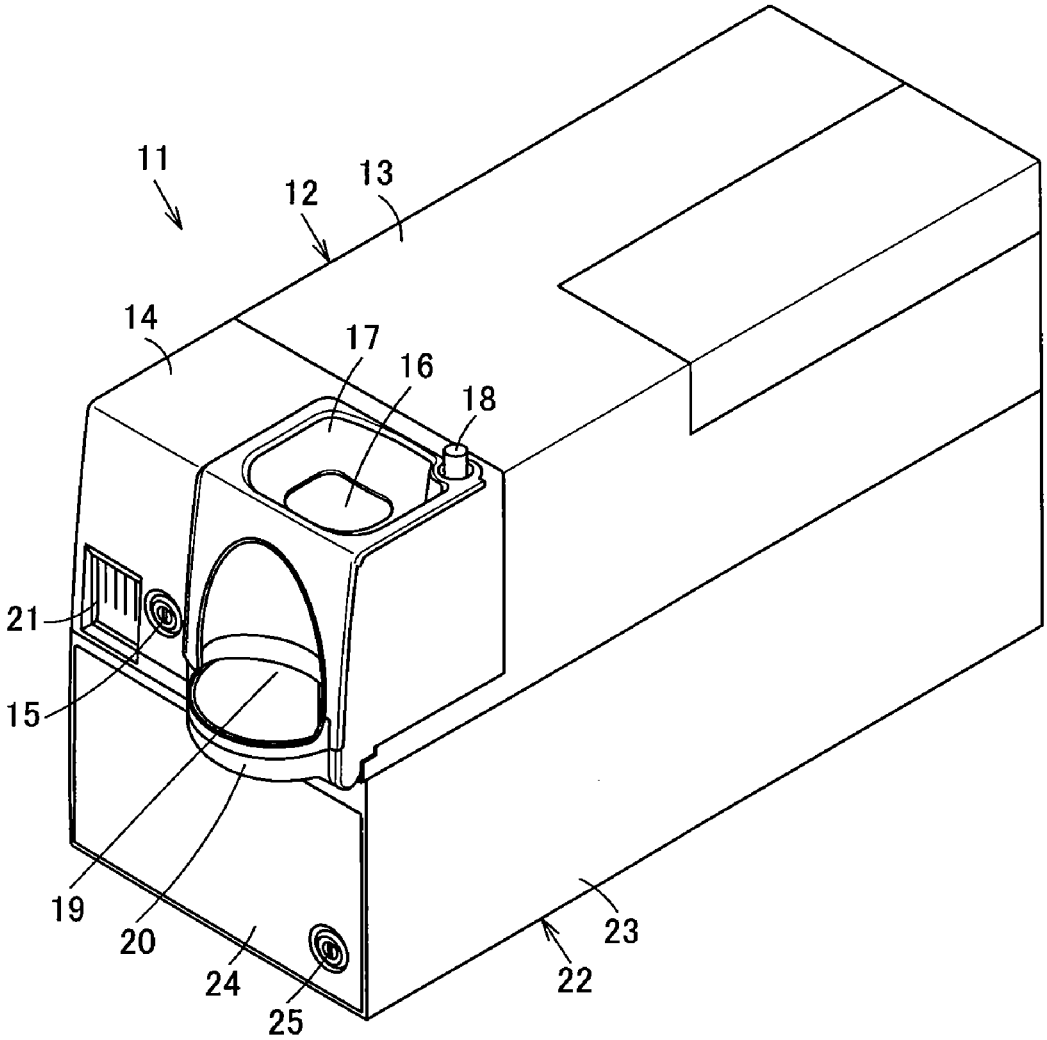
FIG. 13 is a perspective view of the coin depositing and dispensing machine.

FIG. 13 shows a perspective view of a coin depositing and dispensing machine 11. The coin depositing and dispensing machine 11 is electrically connected to, for example, a POS cash register, and can be used as an automatic change dispenser enabling automatic depositing and dispensing of coins.

A machine body 12 of the coin depositing and dispensing machine 11 includes a frame body 13 having an opened front, and a body unit 14 capable of being pulled out from the front of the frame body 13. A locking portion 15 for locking and unlocking the body unit 14, which is housed in the frame body 13, with a key is provided in a front face of the body unit 14.

A recessed coin receiving portion 17, in which a coin receiving port 16 for receiving coins from the outside of the machine body 12 is formed, is disposed on the right side of an upper face of the body unit 14 projecting from the front of the frame body 13. A deposit starting button 18 for instructing the machine to start depositing operation is disposed, with push-down operability, in the vicinity of the coin receiving port 16.

A receptacle 20, on which a coin ejecting port 19 to which coins are ejected from the machine body 12 is formed, is formed on the right side of the front face of the body unit 14. A reject return port 21 for returning coins, which cannot be accepted in the machine body 12, is formed on the left side of the front face of the body unit 14. Coins returned to the reject return port 21 are pooled at the bottom of the reject return port 21, and can be taken out by inserting fingers into the reject return port 21.

Additionally, a coin cassette unit 22 is combined with a lower part of the coin depositing and dispensing machine 11. The coin cassette unit 22 includes a frame body 23 having an opened front, and a coin cassette 24 capable of being pulled out from the front of the frame body 23. A locking portion 25 for locking and unlocking the coin cassette 24, which is housed in the frame body 23, with a key is provided in a front face of the coin cassette 24. The coin cassette 24 accommodates excess coins, coins to be collected, foreign objects and the like, which are discharged from the body unit 14 of the coin depositing and dispensing machine 11.

Figure 2:
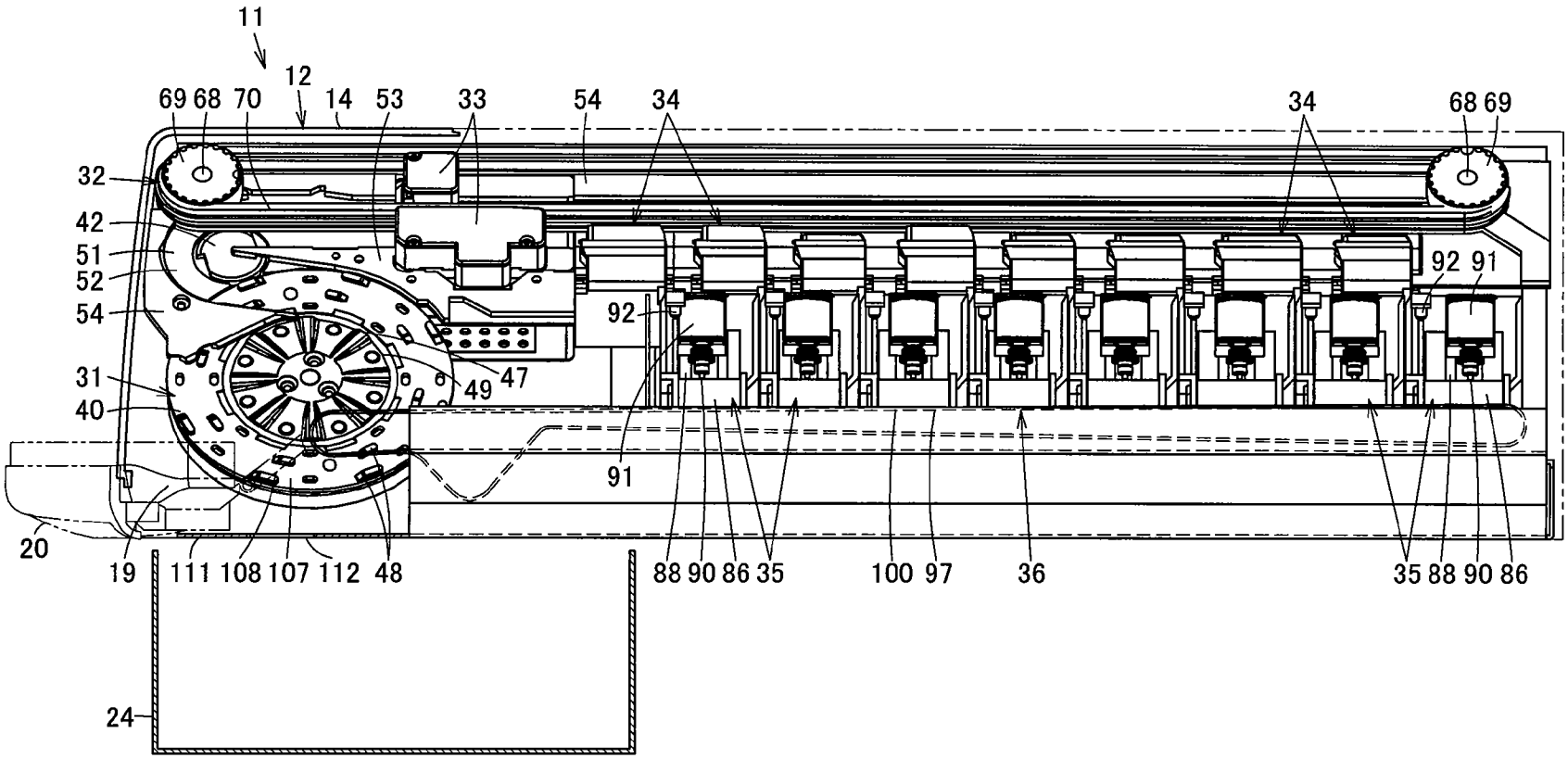
FIG. 2 is a side view showing the inner structure of the coin depositing and dispensing machine.
Figure 3:
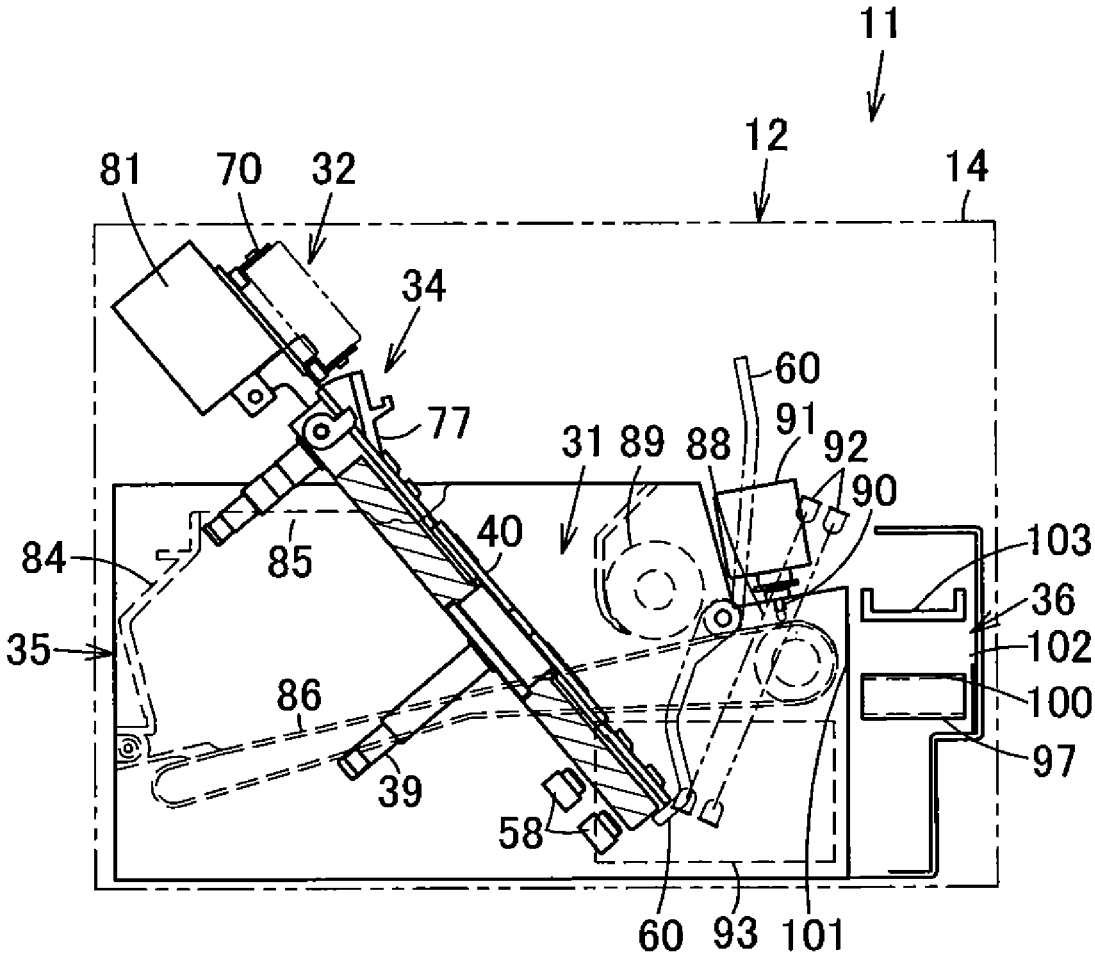
FIG. 3 is a front view showing the inner structure of the coin depositing and dispensing machine.

As shown in FIGS. 1 to 3, the body unit 14 includes: a feeding unit 31 for feeding coins (indicated by the reference symbol C in figures), which are received from the coin receiving port 16, one by one; a depositing and transporting unit 32 for transporting the coins fed from the feeding unit 31 from the front side to the rear side along a left side face which is one side face of the machine body 12; a recognition unit 33 for recognizing the coins transported by the depositing and transporting unit 32; a plurality of sorting units 34 for sorting, for each denomination, the coins transported by the depositing and transporting unit 32 in accordance with the recognition result by the recognition unit 33; denomination-specific coin accommodating and ejecting portions 35 which are successively disposed from the front side to the rear side of the machine body 12, can accommodate coins, which are sorted by the sorting units 34, for each denomination and can eject the accommodated coins one by one in a direction of a right side face which is an other side face of the machine body 12; and a dispensing and transporting unit 36 which is disposed along the right side face of the machine body 12 and transports the coins ejected from the coin accommodating and ejecting portions 35 to the coin ejecting port 19.

As shown in FIGS. 1 to 6, the feeding unit 31 includes: a rotary disc 40 which can be rotated around a rotary axis 39 at a position tilted at a predetermined angle in relation to a horizontal direction; a hopper 41 for pooling coins, which are received from the coin receiving port 16, with the coins not aligned between the hopper 41 and a surface side of the rotary disc 40; and a delivering disc 42 disposed at a position of feeding coins from the upper side of the rotary disc 40 to the depositing and transporting unit.

Around the rotary axis 39 rotatably attached to the machine body 12, the rotary disc 40 is disposed, in view from the front face side of the machine body 12, so as to be tilted rightward in relation to the horizontal direction, a left side higher than the right side thereof, and a surface directed to the right upper side of the machine body 12. The rotary disc 40 is rotation-driven by a motor 44 in a feeding and rotating direction of feeding coins to the depositing and transporting unit 32 (counterclockwise in FIGS. 1 and 3), and in for example, occurrence of a coin jam, maybe rotation-driven in a direction reverse to the feeding and rotating direction so as to remove the coin jam.

A circular high portion 45 is formed at the center of the surface of the rotary disc 40, and an annular low portion 46 is formed on an outer peripheral region of the high portion 45. Stage-shaped coin circumference holding portions 47, each which has a size slightly smaller than the thickness of the smallest coin among coins to be handled by the coin depositing and dispensing machine 11 and each on which a circumference of one coin is mounted in its thickness direction, are provided between the high portion 45 and low portion 46 of the rotary disc 40.

A plurality of picking-up members 48 projecting from the surface of the rotary disc 40 are arranged on the low portion 46 of the rotary disc 40 at a predetermined pitch in two lines in inner and outer circumferential directions. When the rotary disc 40 is rotated in the feeding and rotating direction, each picking-up member 48 on the inner circumferential side holds coins one by one between the member 48 and the coin circumference holding portion 47 and picks up the coin to an upper region of the rotary disc 40, and each picking-up member 48 on the outer circumferential side pushes the picked up coin from the upper part of the rotary disc 40 and delivers it to the delivering disc 42.

The coin circumference holding portion 47 is provided for each position where coins can be held one by one between the coin circumference holding portion 47 and each picking-up member 48. Therefore, the plurality of coin circumference holding portions 47 are provided in the circumferential direction. A sliding-down portion 49 is formed between the coin circumference holding portions 47, the sliding-down portion 49 sliding coins, which cannot be held between the picking-up member 48 and coin circumference holding portion 47, downward on a tilted surface constituted by a difference in level between the high portion 45 and low portion 46.

A guide passage 51 for feeding coins, one by one, picked up to the upper region of the rotary disc 40 by the picking-up members 48 to the depositing and transporting unit 32 is formed on the upper region of the rotary disc 40. The guide passage 51 is curved in an approximate U-like shape from the upper part of the rotary disc 40 and connected to a front end of the depositing and transporting unit 32, and formed by a passage face 52 for transporting coins with one surface of a coin in contact with the face 52, and guide portions 53, 54 for guiding both sides of the coins transported on the passage face 52. The passage face 52 is flush with the surface of the rotary disc 40, that is, disposed in a state of being tilted at a predetermined angle in relation to the horizontal direction.

The guide portion 53 is disposed from the upper region of the rotary disc 40 to a region facing the center of the delivering disc 42. The guide portion 54 is provided so as to be curved from the coin circumference holding portion 47 side to the front end of the depositing and transporting unit 32 in a state of facing a surface of the low portion 46 of the rotary disc 40 at an interval so that no coin enters a space between the surface and the portion 54. A groove portion 55, through which each rotationally moved picking-up member 48 passes, is formed in a surface, which faces the low portion 46, of the guide portion 54. The guide portion 54 receives coins, which are picked up by the picking-up members 48, from the coin circumference holding portions 47 and guides the coins to the depositing and transporting unit 32.

A plurality of detection holes 57 are formed in the low portion 46 of the rotary disc 40 at a predetermined pitch in the circumferential direction. A foreign object detecting sensor 58 as a foreign object detecting unit for detecting a foreign object, which along with the fed coins, etc., remains through the detection holes 57 of the rotated rotary disc 40 is disposed at a position of facing the lower side of the rotary disc 40. As the foreign object, an object which is mixed in the coin receiving port 16 together with coins and other than the coins, a deformed coin having deformation, and the like, are examples.

Additionally, the hopper 41 faces and covers the surface side of the rotary disc 40 and is formed in a shape that is open upward so that coins can be received from the coin receiving port 16. A foreign object discharge port 59 is formed on a lower part of the hopper 41, and a foreign object discharge gate 60 is attached at the foreign object discharge port 59 so as to be openable and closable around an axis 61 as a fulcrum located at the upper side of the gate 60. The foreign object discharge gate 60 is opened and closed, via the axis 61, by a motor 62 as a gate driving portion. In the case where a foreign object, which is not fed from the rotary disc 40 and remains, is detected by the foreign object detecting sensor 58, the foreign object discharge gate 60 is opened, normal and reverse rotation of the rotary disc 40 is alternated, and thus the foreign object is discharged downward from the hopper 41. A foreign object receiving portion (not shown) for receiving a discharged foreign object is disposed under the foreign object discharge gate 60 of the hopper 41, and the foreign object can be taken out from the foreign object receiving portion by pulling out the body unit 14 from the frame body 13.

Additionally, the delivering disc 42 is rotatably arranged at a position laying between the guide passage 51 and the starting end of the depositing and transporting unit 32 so that a surface of the delivering disc 42 is flush with the passage face 52. A pair of projections 64, which comes into contact with a coin and pushes and feeds the coin from the rotary disc 40 side to the depositing and transporting unit 32 side, is projected on an outer circumference of the delivering disc 42.

Figure 4:
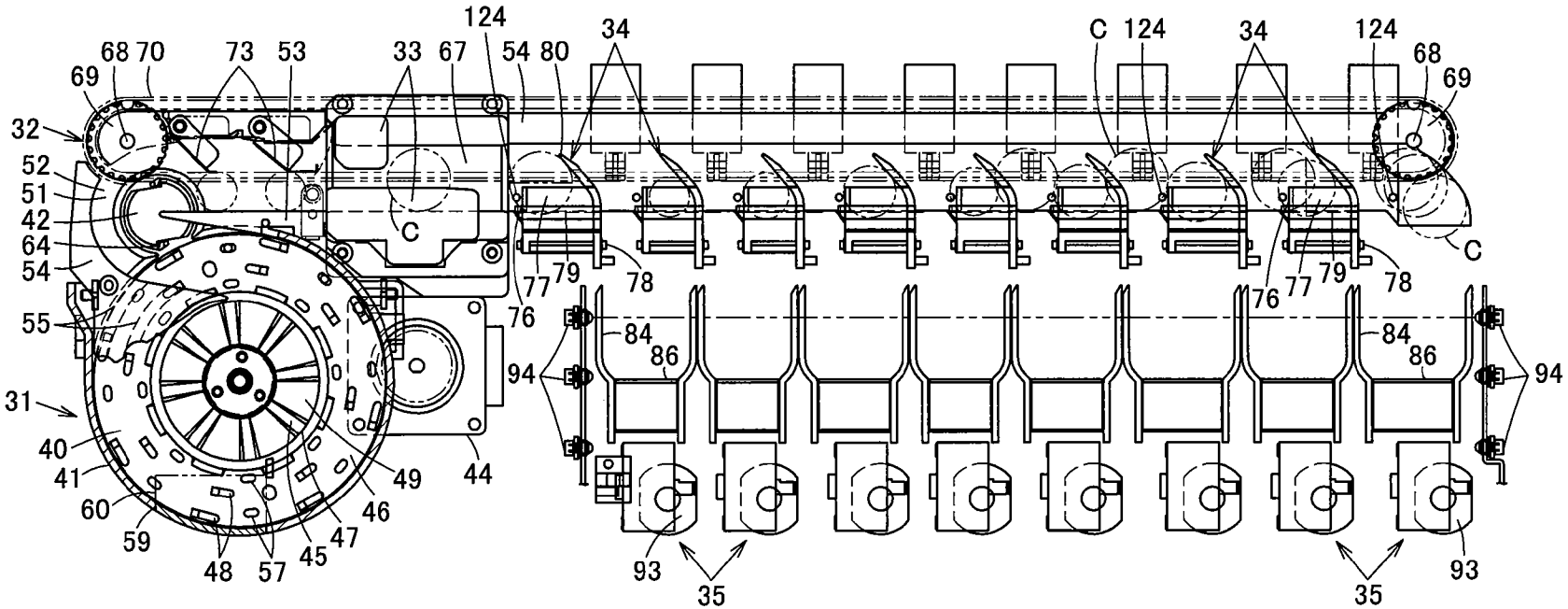
FIG. 4 is a side view of the coin depositing and dispensing machine viewed in a direction perpendicular to a rotary disc of a feeding unit.
Figure 5:
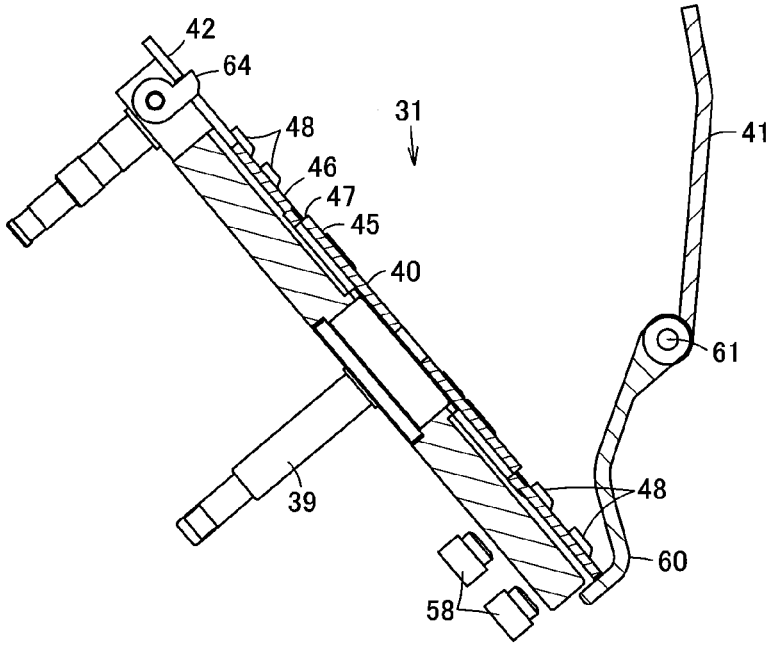
FIG. 5 is a cross sectional view of a state where a foreign object feeding gate of the feeding unit of the coin depositing and dispensing machine is closed.

As shown in FIG. 4, the depositing and transporting unit 32 includes a depositing and transporting passage 67 which is formed continuously to the guide passage 51 so as to extend from the front side to the rear side along the left upper part of the machine body 12. The depositing and transporting passage 67 continues to the guide passage 51 and is formed by the passage face 52 for transporting coins with one surface of the coin in contact with the face 52, and the guide portions 53, 54 for guiding both sides of a coin transported on the passage face 52. The passage face 52 of the depositing and transporting passage 67 is flush with the surface of the rotary disc 40, and thus disposed in a state of being tilted at a predetermined angle in relation to the horizontal direction so that the left side of the face 52 is higher than the right side thereof similar to a tilt of the rotary disc 40. Therefore, coins transported in the depositing and transporting passage 67 are transported in a state where the circumference of the coin is mounted on the guide portion 53 located at a lower position.

Additionally, at a starting end and terminal end of the depositing and transporting passage 67, depositing and transporting pulleys 69 are respectively disposed from rotary axis 68 rotatably attached to the machine body 12. A depositing and transporting belt 70 as a depositing and transporting body is supported along the depositing and transporting passage 67 by the depositing and transporting pulleys 69. The rotary axis 68 is rotatably attached to the machine body 12 perpendicularly to the passage face 52, and the depositing and transporting pulley 69 is rotatable parallel with the passage face 52. A timing pulley having a plurality of teeth on its outer circumference is used as the depositing and transporting pulley 69, and a timing belt having a plurality of teeth on its inner circumference is used as the depositing and transporting belt 70. The depositing and transporting belt 70 is rotated, by the depositing and transporting pulleys 69 rotated by driving of a motor, in a direction of transporting coins from the starting end to the terminal end of the depositing and transporting passage 67.

Projections 71 for pushing and transporting coins one by one are projected on a surface, which faces the passage face 52, of the depositing and transporting belt 70 at a predetermined pitch in a longitudinal direction of the belt. An interval between a plurality of projections 71 in the longitudinal direction of the belt is set to a size that coins can be received one by one between the front and rear projections 71 in the longitudinal direction of the belt and transported. A space capable of receiving a coin having a maximum thickness to be handled by the coin depositing and dispensing machine 11 is formed between the depositing and transporting belt 70 and passage face 52, and a space having a size smaller than the thickness of a coin having minimum thickness to be handled by the coin depositing and dispensing machine 11 is formed between the projections 71 and passage face 52.

Rotation of the depositing and transporting belt 70 is interlocked with the feeding of coins by the rotary disc 40 and delivering disc 42 of the feeding unit 31, and coins fed from the feeding unit 31 are received one by one between the adjacent projections 71 of the depositing and transporting belt 70.

Additionally, a plurality of pulling-over members 73, each of which pulls coins fed from the rotary disc 40 to the depositing and transporting passage 67 over to the guide portion 53 and makes the coins pass, are disposed at an entrance portion of the depositing and transporting passage 67. The pulling-over members 73 are swingably pivotally supported so as to advance and retreat from/to the guide portion 54 into/from the passage, and is biased by a spring (not shown) in a direction of advancing into the passage.

Additionally, the recognition unit 33 and the plurality of sorting units 34 are successively disposed on the downstream side in relation to the pulling-over members 73 in the depositing and transporting passage 67.

The recognition unit 33 detects the quality of material, diameter, etc., of the coin pulled over by the pulling-over members 73, properly selects and recognizes a denomination, authenticity, fatigue, etc., of the coin, and determines whether the coin can be accepted in the machine body 12.

The sorting unit 34 located at a sorting position on the most upstream side in the transporting direction is a sorting unit 34 for sorting rejected coins which cannot be accepted in the machine body 12. The sorting units 34, which are located at the downstream side in relation to the sorting unit 34 located at the most upstream side, are denomination-specific sorting units 34 for sorting coins acceptable in the machine body 12, and are formed in the same structure. Although the sorting unit 34 is not disposed at a sorting position on the most downstream side in the transporting direction, none of the sorting units 34 sort coins and thus the coins are sorted from the terminal end of the depositing and transporting passage 67.

Figure 7:
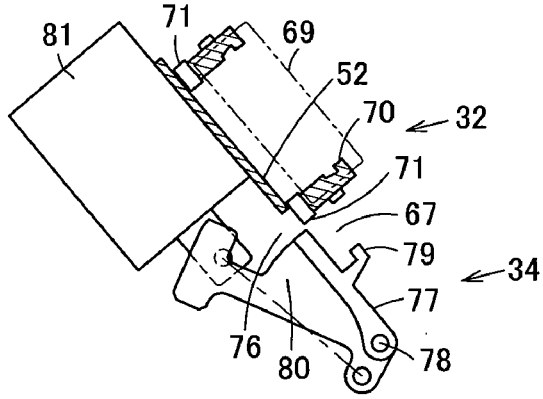
FIG. 7 is a cross sectional view of a state where a sorting unit of the coin depositing and dispensing machine makes coins pass.
Figure 8:
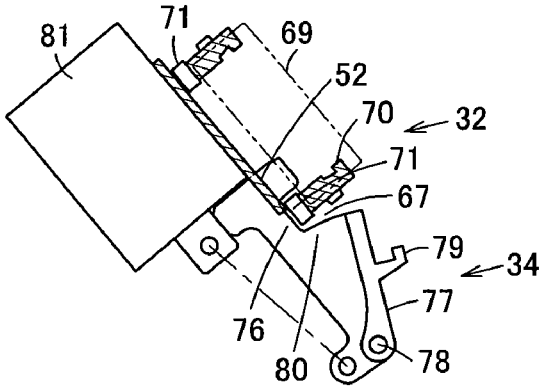
FIG. 8 is a cross sectional view of a state where the sorting unit of the coin depositing and dispensing machine sorts coins.

As shown in FIGS. 4, 7 and 8, each sorting unit 34 includes a sorting member 77 for opening and closing an opening 76 formed from the passage face 52 to the lower guide portion 53. The sorting member 77 is swingably supported between a coin passing position, where the sorting member 77 is inserted into and closes the opening 76, and a coin sorting position, where the sorting member 77 projects from the opening 76 to a surface of the passage face 52 and opens the opening 76, the sorting member 77 having a lower part rotatable around an axis 78 as a fulcrum parallel with the transporting direction.

A surface of the sorting member 77 is flush with the passage face 52 at the coin passing position, where the member 77 is inserted into and closes the opening 76, and a supporting portion 79 serving as a part of the guide portion 53 supporting the circumference of a coin is projected on the surface of the sorting member 77. Additionally, a sorting guide portion 80 is projected from the edge to the back side of the downstream side of the sorting member 77 in the transporting direction. The sorting guide portion 80 projects into the depositing and transporting passage 67, forcibly drops and sorts coins, which are transported by the depositing and transporting belt 70 in the depositing and transporting passage 67, into the opening 76 in a state where the sorting member 77 is swung to the coin sorting position. An upper part of the sorting guide portion 80 is tilted to the upstream side in the transporting direction, and the portion 80 can smoothly sort coins transported from the upstream side in the transporting direction.

A solenoid 81 as a sorting driving portion disposed on the backside of the passage face 52 is linked with the sorting guide portion 80, and a position of the sorting member 77 is switched by driving of the solenoid 81 to the coin passing position or coin sorting position.

Additionally, a chute (not shown) for guiding coins sorted by the sorting units 34 to the reject return port is disposed at a sorting position for rejected coins at the most upstream side in the transporting direction. Denomination-specific chutes (not shown) for guiding coins sorted by each sorting unit to the denomination-specific coin accommodating and ejecting portions 35 are disposed at denomination-specific sorting positions respectively. A chute (not shown) for guiding coins ejected from the terminal end of the depositing and transporting passage 67 to the coin accommodating and ejecting portion 35 located at the rearmost part of the machine body 12 is disposed at a sorting position at the most downstream side in the transporting direction.

Figure 9:
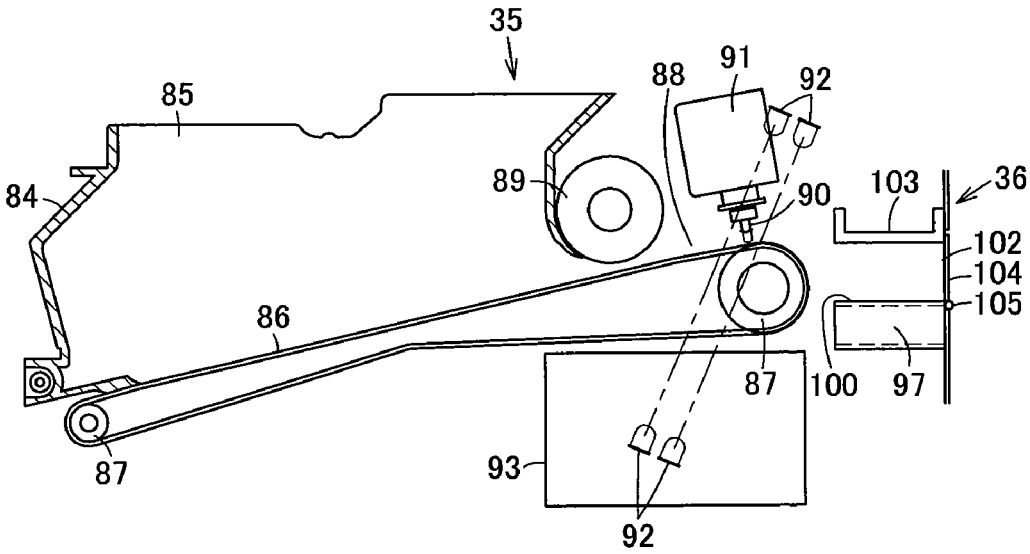
FIG. 9 is a cross sectional view of a coin accommodating and ejecting portion and dispensing and transporting unit of the coin depositing and dispensing machine.

Next, as shown in FIG. 1, the denomination-specific coin accommodating and ejecting portions 35 are successively juxtaposed from the front side to the rear side of the machine body 12. As shown in FIG. 9, each coin accommodating and ejecting portion 35 includes an accommodating frame 84 for accommodating coins with the coins not aligned. A coin receiving and accommodating port 85 for receiving coins sorted by the sorting unit 34 from the depositing and transporting passage 67 is formed at an upper part of the accommodating frame 84. An accommodating and ejecting belt 86 for supporting the accommodated non-aligned coins is disposed at the bottom of the accommodating frame 84. The accommodating and ejecting belt 86 is supported in a lateral direction of the machine body 12 by accommodating and ejecting rollers 87 which are pivotally supported horizontally in relation to the machine body 12 and rotatable, and so as to be tilted upward from the upstream side to the downstream side in the transporting direction of coins, that is, from the depositing and transporting unit 32 side of the left side to the dispensing and transporting unit 36 side of the right side.

An accommodated coin ejection port 88 for ejecting accommodated coins to the dispensing and transporting unit 36 is formed at the downstream side in the transporting direction of the accommodating and ejecting belt 86.

A reverse roller 89 is disposed at an upper region of the accommodated coin ejection port 88 of the accommodating and ejecting belt 86, the reverse roller 89 being rotated reversely to the transporting direction of the accommodating and ejecting belt 86, aligning non-aligned coins on the accommodating and ejecting belt 86 in one layer and one line and ejecting the coins from the accommodated coin ejection port 88.

An ejection controlling member 90, which controls coins to be ejected from the accommodated coin ejection port 88 so that the coins are ejected one by one, is disposed at the upper region of the accommodated coin ejection port 88 of the accommodating and ejecting belt 86 and on the downstream side in relation to the reverse roller 89 in the transporting direction. The ejection controlling member 90, by a solenoid 91 attached to the machine body 12, can advance into and retreat from the accommodated coin ejection port 88 from above, thereby preventing ejection of coins in advancing and permitting the ejection of coins in retreating.

An ejected coin number detecting portion 92 is disposed at the accommodated coin ejection port 88, the ejected coin number detecting portion 92 detecting coins passing through the accommodated coin ejection port 88 and thus detecting the number of coins ejected from the accommodated coin ejection port 88.

A motor 93 for rotating the accommodating and ejecting belt 86 and reverse roller 89 is disposed under the accommodating and ejecting belt 86.

As shown in FIG. 4, a plurality of coin detecting sensors 94 are disposed for emitting detection light so that the light passes through the plurality of coin accommodating and ejecting portions 35 and detecting coins in the coin accommodating and ejecting portions 35. One of the coin detecting sensors 94 is arranged in the vicinity of the coin receiving and accommodating port 85, and serves as a part of a full state detecting portion for detecting the coin accommodating and ejecting portion 35 is filled with coins.

Figure 10:
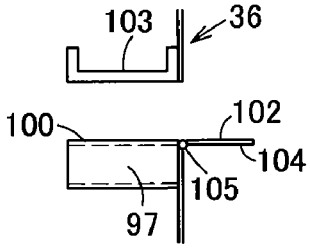
FIG. 10 is a cross sectional view of a state where an opening and closing door of the dispensing and transporting unit of the coin depositing and dispensing machine is opened.
Figure 11:
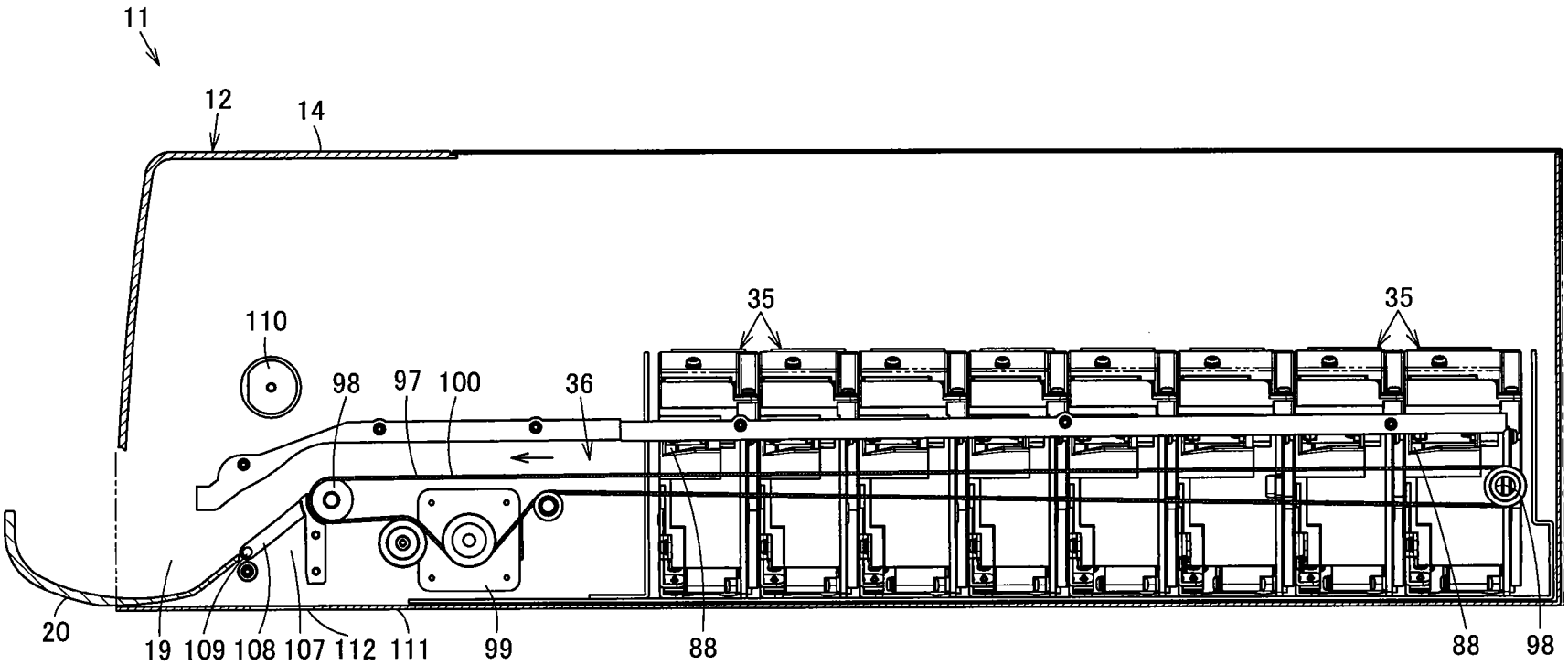
FIG. 11 is a side view of the coin accommodating and ejecting portions and dispensing and transporting unit of the coin depositing and dispensing machine.

Next, as shown in FIGS. 9 to 11, the dispensing and transporting unit 36 includes an endless dispensing and transporting belt 97 as a dispensing and transporting body disposed aside of the accommodated coin ejection ports 88 of the plurality of coin accommodating and ejecting portions 35 in a longitudinal direction of the machine body 12. The dispensing and transporting belt 97 is supported by a plurality of dispensing and transporting pulleys 98, which are pivotally supported horizontally in relation to the machine body 12 and rotatable, and is rotated by driving of a motor 99 so that an upper face of the dispensing and transporting belt 97 is moved forward to the coin ejecting port 19. The upper face of the dispensing and transporting belt 97 is arranged lower than the plurality of accommodated coin ejection ports 88 of coin accommodating and ejecting portions 35, and constituted as a coin transporting face 100 which receives a plurality of coins ejected from the accommodated coin ejection ports 88 and can transport the coins forward to the coin ejecting port 19.

The coin transporting face 100 of the dispensing and transporting belt 97 is surrounded by dispensing passage walls 101, 102 located at both sides of it and a dispensing passage wall 103 located above it. In the side dispensing passage wall 102 facing outward from the machine body 12, a plurality of opening and closing doors 104 are attached each so as to be openable and closable on an axis 105 as a fulcrum. The upper dispensing passage wall 103 is transparent, and provided openably and closably if necessary. The upper dispensing passage wall 103 is arranged so that coins ejected from the accommodated coin ejection ports 88 of the coin accommodating and ejecting portions 35 can be received under the upper dispensing passage wall 103. An interval between the upper dispensing passage wall 103 and the coin transporting face 100 of the dispensing and transporting belt 97 is set to a size smaller than the diameter of the smallest coin among coins to be handled by the coin depositing and dispensing machine 11.

Figure 12:
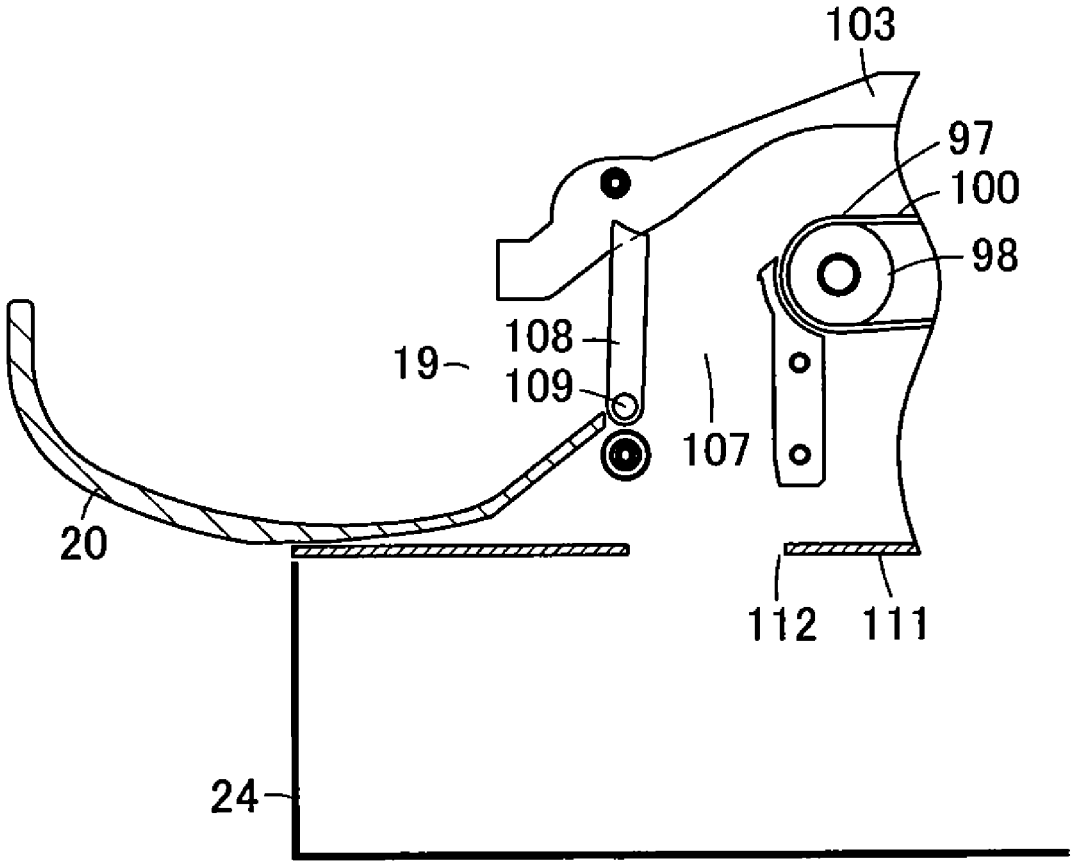
FIG. 12 is a side view of a state where a coin is discharged to a coin cassette from the dispensing and transporting unit of the coin depositing and dispensing machine.

As shown in FIGS. 1, 11 and 12, a coin discharge port 107, through which coins transported by the dispensing and transporting belt 97 are dropped and can be discharged outside the machine body 12, is formed between the downstream side in the transporting direction of the dispensing and transporting belt 97 of the dispensing and transporting unit 36 and the coin ejecting port 19. A switching gate 108 is disposed at the coin discharge port 107, the gate 108 switching a transport destination of a coin, which is transported by the dispensing and transporting belt 97, to the coin ejecting port 19 or coin discharge port 107. A position of the switching gate 108 is switched by driving of a motor 110, on an axis 109 as a fulcrum located at the end on the coin ejecting port 19 side of the gate 108, to a position of closing the coin discharge port 107 and guiding coins ejected from the dispensing and transporting belt 97 from the coin discharge port 107 to the receptacle 20, or a position of closing the coin ejecting port 19 and guiding the coins ejected from the dispensing and transporting belt 97 to the coin discharge port 107.

An opening 112 for accommodating coins discharged from the coin discharge port 107 into the coin cassette 24 is formed in a bottom plate 111, which is located under the coin discharge port 107, of the body unit 14.

Figure 14:
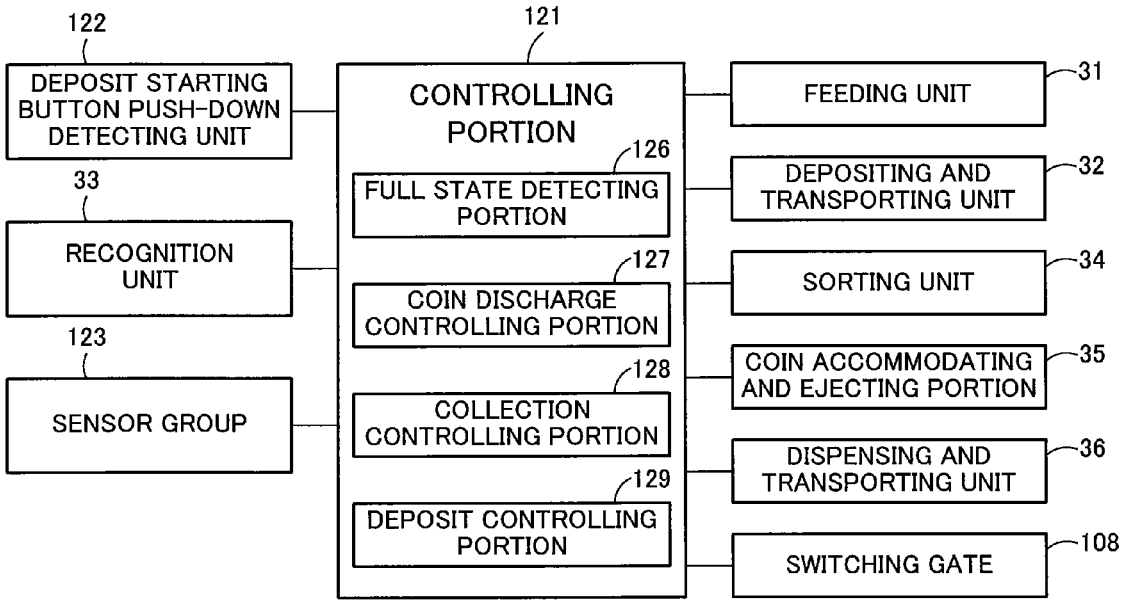
FIG. 14 is a block diagram of the coin depositing and dispensing machine.

Next, FIG. 14 shows a block diagram of the coin depositing and dispensing machine 11, and the reference numeral 121 denotes a controlling portion for controlling the whole of coin depositing and dispensing machine 11. Signals are input into the controlling portion 121 from a deposit starting button push-down detecting unit 122 for detecting push-down of the deposit starting button 18, the recognition unit 33, a sensor group 123 including various sensors for detecting coins at each position in the coin depositing and dispensing machine 11, and the like. The sensor group 123 includes, for example: the foreign object detecting sensor 58 of the feeding unit 31; a plurality of coin position detecting sensors 124 (see FIG. 4) which are provided along the depositing and transporting passage 67 and detects positions of coins transported in the depositing and transporting passage 67; and the ejected coin number detecting portion 92 and coin detecting sensor 94 of the coin accommodating and ejecting portion 35.

The controlling portion 121 controls driving portions, such as a motor and solenoid, operating the feeding unit 31, depositing and transporting unit 32, sorting unit 34, coin accommodating and ejecting portions 35, dispensing and transporting unit 36, switching gate 108 and the like.

The controlling portion 121 has various functions of controlling the coin depositing and dispensing machine 11, and some of the functions will be described below.

A full state detecting portion 126 counts the number of accommodated coins, which are sorted for each denomination by the sorting unit 34 and accommodated in each coin accommodating and ejecting portion 35, in the depositing operation, and detects a full state when the number of accommodated coins reaches the predetermined upper limit number, or detects the full state by combining the number of coins with detection of the coin detecting sensor 94 arranged in the vicinity of the coin receiving and accommodating port 85.

In the case where the full state detecting portion 126 detects, in the depositing operation, the coin accommodating and ejecting portion 35 is filled with coins, a coin discharge controlling portion 127 switches a direction of the switching gate 108 to a direction of guiding coins to the coin discharge port 107 side, causes the coin accommodating and ejecting portion 35, which is detected to be in the full state eject coins, and causes the dispensing and transporting unit 36 to transport the coins ejected from the coin accommodating and ejecting portion 35 to the coin discharge port 107.

When all coins in the coin accommodating and ejecting portion 35 are collected outside the machine body 12, a collection controlling portion 128 enables the coin ejecting port 19 or coin discharge port 107 to be selected as a transport destination of the coins in the coin accommodating and ejecting portion 35.

In the case where the push-down of the deposit starting button 18 is detected by the deposit starting button push-down detecting unit 122, a deposit controlling portion 129 drives the feeding unit 31 and depositing and transporting unit 32 to start the depositing operation.

Next, operation of the coin depositing and dispensing machine 11 of the present embodiment will be described.

The depositing operation will be first described.

A cashier or the like puts coins to be deposited into the coin receiving port 16 and pushes down the deposit starting button 18.

When the push-down of the deposit starting button 18 is detected by the deposit starting button push-down detecting unit 122, the feeding unit 31 and depositing and transporting unit 32 are driven and the depositing operation is started. Therefore, the depositing operation is not uncontrollably started simply by putting coins into the machine, and can be started based on the will of an operator such as a cashier.

Coins put into the coin receiving port 16 drop into the hopper 41 and are guided so as to fall down onto the surface of the rotary disc 40. In the feeding unit 31, by start of the depositing operation, the rotary disc 40 and delivering disc 42 are rotated, and coins are picked up one by one by each picking-up member 48 projecting from the surface of the rotary disc 40, sent from the upper part of the rotary disc 40 to the guide passage 51 and delivered one by one to the delivering disc 42. Coins received by the projections 64 of the delivering disc 42 are sent one by one to the depositing and transporting passage 67 of the depositing and transporting unit 32.

In the depositing and transporting unit 32, by start of the depositing operation, the depositing and transporting belt 70 is rotated, and the coins sent one by one by the projections 64 of the delivering disc 42 of the feeding unit 31 are received between the adjacent projections 71 of the depositing and transporting belt 70, and transported in the depositing and transporting passage 67 to the downstream side in the transporting direction while being pushed by the projection 71 on the upstream side in the transporting direction.

The coin transported in the depositing and transporting passage 67 comes into contact with the pulling-over members 73 at the entrance portion of the depositing and transporting passage 67, is pulled over so that the circumference of the coin comes into contact with the guide portion 53 located at the lower side, and passes through the entrance portion. The coin, which is transported in the state of being in contact with the guide portion 53 located at the lower side and pulled over, is recognized by the recognition unit 33.

In the case where the transported coin is a coin which cannot be accepted in the machine body 12, that is, a rejected coin as a result of recognition by the recognition unit 33, the rejected coin is sorted, by the sorting unit 34 for rejected coins located at the most upstream side in the transporting direction, from the depositing and transporting passage 67. That is, in accordance with timing that the rejected coin reaches the sorting unit 34 for rejected coins, the solenoid 81 is driven, the sorting member 77 is projected from the opening 76 to the surface of the passage face 52 and swung to the coin sorting position of opening the opening 76, and coins transported by the depositing and transporting belt 70 in the depositing and transporting passage 67 are forcibly dropped into the opening 76 and sorted by the sorting guide portion 80 of the sorting member 77, as shown in FIG. 8. The rejected coins sorted by the sorting unit 34 are returned to the reject return port 21, this is indicated by a display lamp (not shown) provided on the front face of the body unit 14 or buzzer, and the rejected coins can be taken out by the cashier, etc.

In the case where a coin to be deposited is a normal coin which can be accepted in the machine body 12 as a result of recognition of the recognition unit 33, the coin is transported to a predetermined position of the sorting unit 34 of the corresponding denomination and sorted from the depositing and transporting passage 67 to the coin accommodating and ejecting portion 35. Here, since the sorting member 77 is located at the coin passing position of being inserted in the opening 76 and closing the opening 76 in each sorting unit 34 located at the upstream side in relation to the sorting unit 34 of the corresponding denomination, the coin passes through each sorting unit 34 located at the upstream side and can be sorted by the sorting unit 34 of the corresponding denomination. The sorting operation of the denomination-specific sorting unit 34 is same as that of the sorting unit 34 for rejected coins.

The coins sorted by the denomination-specific sorting unit 34 drop from the coin receiving and accommodating port 85 into accommodating frame 84 of the coin accommodating and ejecting portion 35 of the corresponding denomination, and are accommodated on the accommodating and ejecting belt 86 or among the coins already accommodated.

If the foreign object detecting sensor 58 for detecting coins, etc., on the rotary disc 40 outputs no detection signal for a predetermined time and the recognition unit 33 does not recognize coins for a predetermined time, completion of processing of coins put in the coin receiving port 16 is determined, and the feeding unit 31 and depositing and transporting unit 32 are stopped and the depositing operation is ended.

Additionally, in the case where a foreign object is put in together with coins, the foreign object drops in the midst of being picked up by the picking-up members 48 of the rotary disc 40 from the lower side to upper side of the rotary disc 40, or cannot be delivered to the projections 64 of the delivering disc 42 and drops even if being picked up by the picking-up members 48, and thus remains on the rotary disc 40. Moreover, as a foreign object, a deformation coin having a deformed outer shape, and the like are also included.

Figure 6:
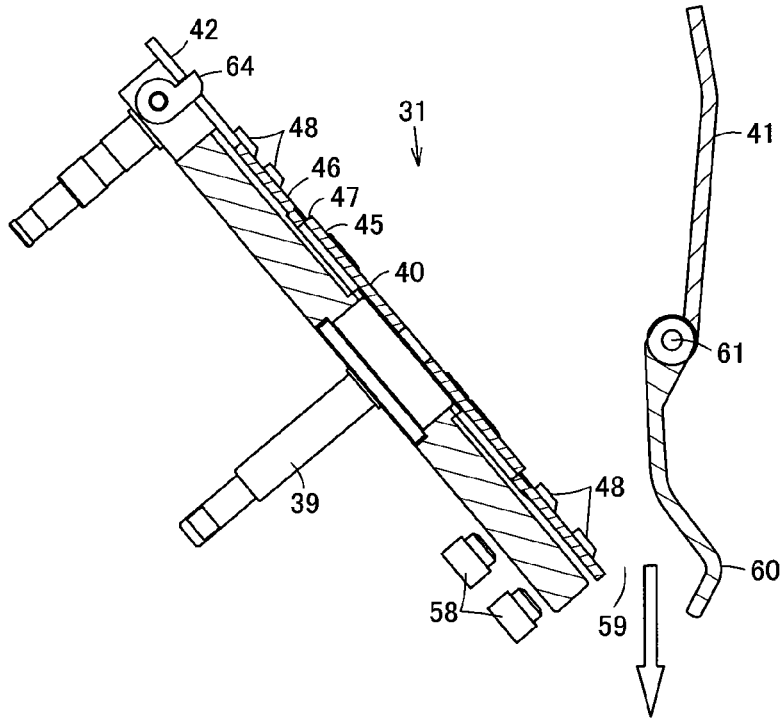
FIG. 6 is a cross sectional view of a state where the foreign object feeding gate of the feeding unit of the coin depositing and dispensing machine is opened.

In this case, although the foreign object detecting sensor 58 for detecting coins on the rotary disc 40 outputs detection signals, the recognition unit 33 does not identify coins for a predetermined time, and therefore it is determined the foreign object remains. In the case where a foreign object remains, the foreign object discharge gate 60 of the hopper 41 is opened, the foreign object discharge port 59 of the hopper 41 is opened, and the foreign object on the rotary disc 40 is discharged, as shown in FIG. 6. Since the discharged foreign object is received to the foreign object receiving portion arranged at the bottom of the body unit 14, the cashier or the like pulls the body unit 14 out from the frame body 13 and thus the foreign object is taken out and returned from the foreign object receiving portion.

Additionally, in the depositing operation, in the case where the coin accommodating and ejecting portion 35 is filled with coins, coins cannot be accommodated in the coin accommodating and ejecting portion 35. Therefore, unless the coins are collected from the coin accommodating and ejecting portion 35, the next depositing transaction cannot be performed, and halting of the depositing transaction by detection of the full state becomes one factor in obstructing efficient management.

Thereupon, in the depositing operation, in the case where the full state detecting portion 126 detects the full state of the coin accommodating and ejecting portion 35, the direction of the switching gate 108 is switched to the direction of guiding coins to the coin discharge port 107, the coin accommodating and ejecting portion 35 in the detected full state is made to eject coins one by one, and the coins ejected from the coin accommodating and ejecting portion 35 are transported to the coin discharge port 107 by the dispensing and transporting unit 36 and collected in the coin cassette 24, as shown in FIG. 12. Thus, the depositing transaction is not interrupted and processing can be continued.

Additionally, in the case where a coin jam arises in the depositing and transporting passage 67, the body unit 14 is pulled out from the frame body 13, and the coins jamming the depositing and transporting passage 67 are taken out from the depositing and transporting passage 67. Here, since the depositing and transporting passage 67 is tilted in accordance with the tilt of the rotary disc 40, the coins jamming the depositing and transporting passage 67 can be easily taken out upward from the upper side in a tilting direction of the tilted depositing and transporting passage 67, and the coin jam can be easily removed.

Next, a dispensing operation will be described.

By a signal of a dispensing instruction from, for example, a POS cash register, the coin accommodating and ejecting portion 35 accommodating coins of the corresponding denomination to be dispensed is driven. In the coin accommodating and ejecting portion 35 of the corresponding denomination, the accommodating and ejecting belt 86 is rotated and the reverse roller 89 is reversely rotated by driving of the motor 93, and coins not aligned on the accommodating and ejecting belt 86 are aligned in one layer and one line by the reverse roller 89 and ejected from the accommodated coin ejection port 88. Here, the ejection controlling member 90 is made to retreat from the accommodated coin ejection port 88 by the solenoid 91, and the ejected coin number detecting portion 92 detects the ejected coins and counts the number thereof. When the number of ejected coins of the corresponding denomination reaches the number of coins to be dispensed, the ejection controlling member 90 is made to enter the accommodated coin ejection port 88 by the solenoid 91 to forcibly stop ejection of the coins, and the motor 93 is stopped and ejecting operation is stopped.

The coins ejected from the accommodated coin ejection port 88 of the coin accommodating and ejecting portion 35 pass between the dispensing and transporting belt 97 of the dispensing and transporting unit 36 and the upper dispensing passage wall 103, and are received onto the coin transporting face 100 of the dispensing and transporting belt 97.

Coins to be dispensed on the coin transporting face 100 of the dispensing and transporting belt 97 are ejected to the coin ejecting port 19 by rotating the dispensing and transporting belt 97 by driving of the motor 99 of the dispensing and transporting unit 36, and dispensed to the receptacle 20. Here, as shown in FIG. 11, the switching gate 108 closes the coin discharge port 107 and guides the coins ejected from the dispensing and transporting belt 97 to the receptacle 20.

Moreover, the dispensing and transporting belt 97 is rotated at the time of the ejecting operation of coins from the coin accommodating and ejecting portion 35, and may successively transport the coins successively ejected from the coin accommodating and ejecting portion 35 and eject them to the coin ejecting port 19, or may pool all coins to be dispensed on the dispensing and transporting belt 97 and then transport and eject them all together to the coin ejecting port 19.

In the case where all the coins to be dispensed are pooled on the dispensing and transporting belt 97, the motor 99 is normally and reversely rotated, and the dispensing and transporting belt 97 is reciprocally moved in the longitudinal direction of the belt. Thus, even if a plurality of coins are ejected from one coin accommodating and ejecting portion 35, they are dispersedly pooled on the dispensing and transporting belt 97 in the longitudinal direction of the belt. Therefore, the coins are not pooled together at one place on the dispensing and transporting belt 97 and a coin jam can be prevented.

Additionally, since the interval between the coin transporting face 100 of the dispensing and transporting belt 97 and the upper dispensing passage wall 103 is smaller than the diameter of the smallest coin among coins to be handled by the coin depositing and dispensing machine 11, coins can be prevented from being stood up between the coin transporting face 100 of the dispensing and transporting belt 97 and the upper dispensing passage wall 103, and a coin jam and any remaining coins can be prevented in the dispensing and transporting unit 36.

Additionally, in the dispensing and transporting unit 36, the upper dispensing passage wall 103 is transparent, and thus positions of coins can be easily specified even in the case where a malfunction such as a coin jam or any remaining coins arise.

Further, since the opening and closing doors 104 are provided in the dispensing passage wall 102 facing the outside of the machine body 12, a malfunction such as a coin jam or any remaining coins can be easily removed by opening the opening and closing doors 104. Moreover, if the upper dispensing passage wall 103 is also openable and closable, a malfunction such as a coin jam or any remaining coins can be further easily removed.

Next, a collecting operation will be described.

When all coins in the coin accommodating and ejecting portion 35 are collected outside the machine body 12, the coin ejecting port 19 or coin discharge port 107 can be arbitrarily selected as a transport destination of the coin in the coin accommodating and ejecting portion 35.

In the case where the coin ejecting port 19 is selected, the direction of the switching gate 108 is switched to a direction of guiding coins to be collected to the coin ejecting port 19 side, and the coins to be collected are ejected one by one from the coin accommodating and ejecting portion 35, transported to the coin ejecting port 19 by the dispensing and transporting unit 36 and ejected to the receptacle 20, as shown in FIG. 11. The coins to be collected and ejected to the receptacle 20 are taken out and collected.

Additionally, in the case where the coin discharge port 107 is selected, the direction of the switching gate 108 is switched to the direction of guiding coins to be collected to the coin discharge port 107, and the coins to be collected are ejected one by one from the coin accommodating and ejecting portion 35, transported to the coin discharge port 107 by the dispensing and transporting unit 36 and accommodated into the coin cassette 24, as shown in FIG. 12.

When all the coins in the coin accommodating and ejecting portion 35 are accommodated in the coin cassette 24, the coin cassette 24 is pulled out from the frame body 23 and the coins to be collected in the coin cassette 24 are collected.

As described above, in the coin depositing and dispensing machine 11, the rotary disc 40 rotated at the position tilted at a predetermined angle in relation to the horizontal direction is used for the feeding unit 31 for feeding coins received from the coin receiving port 16 one by one to the depositing and transporting unit 32, and thus only coins are fed to the depositing and transporting unit 32 and a foreign object mixed with the coins is not fed to the depositing and transporting unit 32. Thus, the foreign object can be prevented from causing a malfunction in the depositing and transporting unit 32, etc.

Additionally, the depositing and transporting unit 32 and dispensing and transporting unit 36 are arranged opposite to each other in the machine body 12, the depositing and transporting unit 32 is tilted in accordance with the tilt of the rotary disc 40, the dispensing and transporting unit 36 is horizontally positioned, and thus coins in a depositing and transporting system and coins in a dispensing and transporting system can be easily distinguished from each other. Thus, in the case where a coin jam arises in the machine body 12, coins managed in the machine and coins managed outside the machine are easily distinguished from each other and management of coins in processing can be exactly distinguished.

Figure 15:
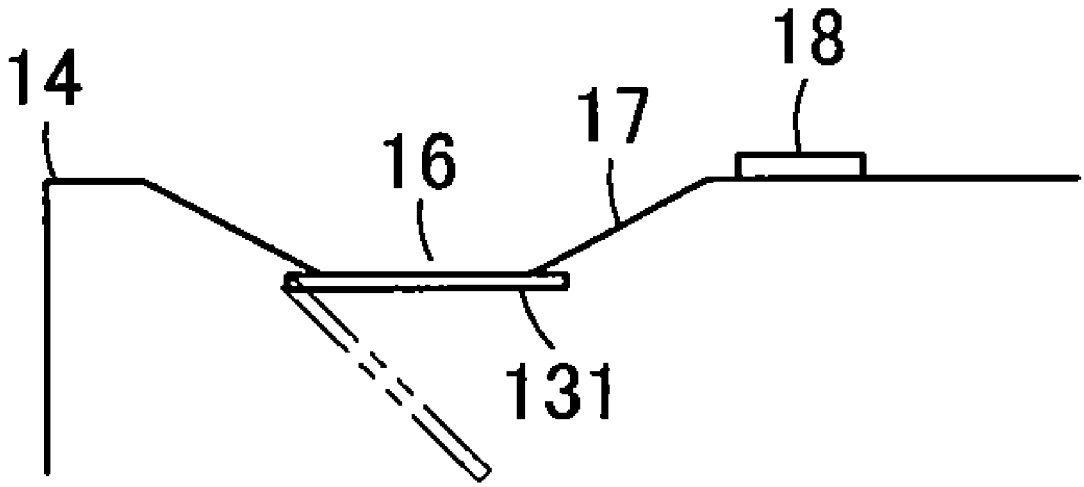
FIG. 15 is a cross sectional view showing a temporary storage cover portion of a coin depositing and dispensing machine of a second embodiment of the present invention.
Figure 16:
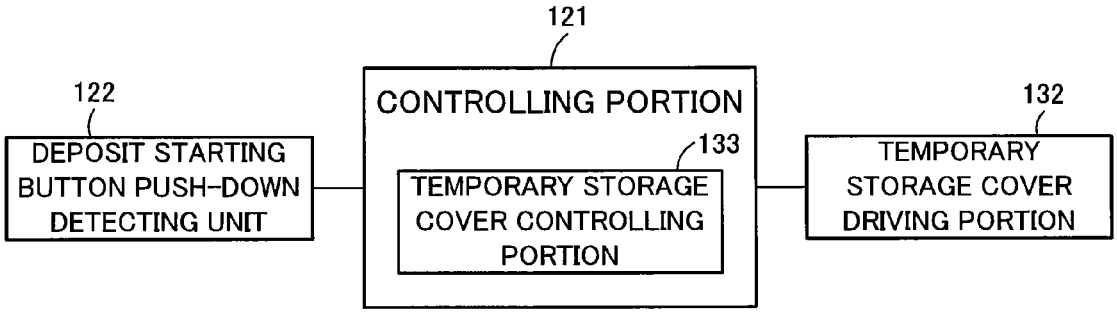
FIG. 16 is a block diagram relating to control of the temporary storage cover of the coin depositing and dispensing machine.

Next, another embodiment of the present invention will be described with reference to FIGS. 15 and 16.

A temporary storage cover 131 capable of covering and uncovering the coin receiving port 16 is disposed between the coin receiving port 16 and feeding unit 31 located under the coin receiving port. The temporary storage cover 131 is automatically opened and closed by driving of a temporary storage cover driving portion 132 such as a motor or solenoid.

The controlling portion 121 serves as a temporary storage cover controlling portion 133 regarding control of the temporary storage cover 131. In the temporary storage cover controlling portion 133, the temporary storage cover 131 is normally closed, coins received from the outside of the machine body 12 can be temporarily stored on the closed temporary storage cover 131. Additionally, in the case where the push-down of the deposit starting button 18 is detected by the deposit starting button push-down detecting unit 122, the temporary storage cover 131 is opened and the coins on the temporary storage cover 131 are dropped onto the feeding unit 31.

When the cashier puts coins into the coin receiving port 16, the put-in coins are temporarily stored on the closed temporary storage cover 131 and thus can be checked once. Additionally, coins can be additionally put in, and coins are not put into the feeding unit 31 at an erroneous timing.

Then, the cashier pushes down the deposit starting button 18, the push-down of the deposit starting button 18 is detected, the temporary storage cover 131 is opened, the coins on the temporary storage cover 131 are dropped onto the feeding unit 31, the feeding unit 31 and depositing and transporting unit 32 are driven by control of the deposit controlling portion 129, the depositing operation is started, and thus the depositing operation is not uncontrollably started in e.g. putting coins into the machine and can be started based on the will of the cashier.

Figure 17:
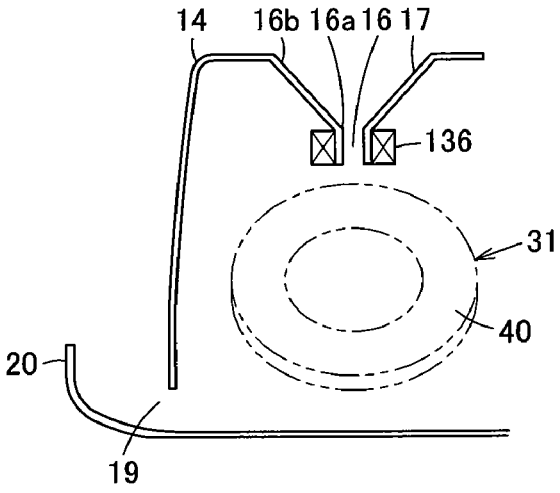
FIG. 17 is a side view showing an inner structure of a coin depositing and dispensing machine of a third embodiment of the present invention.
Figure 18:
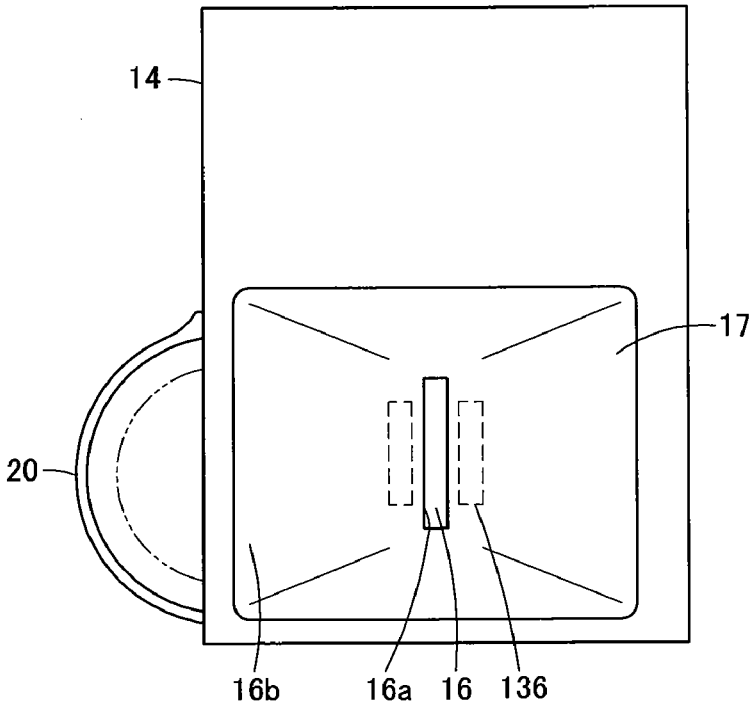
FIG. 18 is a top plan view of a coin receiving port of the coin depositing and dispensing machine.

Another embodiment of the present invention will be described with reference to FIGS. 17 and 18.

A lower opening 16a of the coin receiving port 16 is formed narrower and smaller than an upper opening 16b thereof. For example, the lower opening 16a is formed in the shape of a slit through which a coin passes only in a state where a surface of the coin is directed in one direction.

A received coin detecting sensor 136 for detecting coins passing through the lower opening 16a is disposed on the outer periphery of the lower opening 16a of the coin receiving port 16. A magnetic sensor for magnetically detecting a pass of the coin is used for the received coin detecting sensor 136.

The deposit controlling portion 129 of the controlling portion 121 of FIG. 14 drives the feeding unit 31 and depositing and transporting unit 32, and starts the depositing operation in the case where receipt of coins is detected by the received coin detecting sensor 136.

Since the lower opening 16*a* of the coin receiving port 16 is formed to be narrower and smaller than the upper opening 16*b*, receipt of coins to the coin receiving port 16 can be reliably detected by the received coin detecting sensor 136 disposed on the outer periphery of the lower opening 16*a* of the coin receiving port 16. Thus, in the case where the receipt of coins is detected, the feeding unit 31 and depositing and transporting unit 32 are driven and the depositing operation can be automatically started.

Additionally, since the lower opening 16*a* of the coin receiving port 16 is formed to be narrower and smaller than the upper opening 16*b*, a foreign object can be prevented from being put into the machine body 12. Coins put in the feeding unit 31 from the coin receiving port 16 are not seen from the outside thereby increasing security, and leakage of a noise from the machine body 12 outward with the depositing operation is reduced.

Moreover, in each above embodiment, the coin depositing and dispensing machine 11 may be singly used without the coin cassette unit 22. In this case, the function of accommodating excess coins and coins to be collected, into the coin cassette 24 is not available.

Additionally, a reject box capable of accommodating rejected coins to be returned may optionally be provided in the reject return port 21 so as to be pulled out from the body unit 14.

In the case where the rejected coins are detected and returned to the reject box in the depositing operation, this rejection may be indicated by a display lamp (not shown) provided on the front face of the body unit 14 or buzzer. Here, if such indication is performed during coin counting of the depositing operation, the depositing operation becomes erroneous when the reject box is pulled out regardless of whether during coin counting. Therefore, by performing such indication at a timing after completion of the coin counting of the depositing operation, the depositing operation can be prevented from becoming erroneous.

Further, if the reject box is locked to the body unit by an electric-magnetic lock in the depositing operation and the electric-magnetic lock is ejected simultaneously with the indication at the timing after the completion of the coin count of the depositing operation, the depositing operation can be further reliably prevented from becoming erroneous.

The present invention is applied to an automatic change dispenser combined with a POS cash register in, for example, a shop, and to a coin depositing and dispensing machine of an ATM (Automated Teller Machine) installed in a teller position or inside and outside a bank branch in, for example, a financial institution.

The invention claimed is:

1. A coin depositing and dispensing machine comprising:

a machine body having a front face, a rear face, and a first face and a second face in lateral direction of the machine body;

a coin receiving port for receiving coins from the outside of a machine body of the coin depositing and dispensing machine;

a coin ejecting port for ejecting coins outward from the inside of the machine body;

a feeding unit which includes a rotary disc rotated around a rotary axis attached to the machine body at a position tilted at a predetermined angle in relation to a horizontal direction and a hopper for accommodating coins, which are received from the coin receiving port, on a surface side of the rotary disc with the coins not aligned, and can feed the coins, which are received from the coin receiving port, one by one;

a depositing and transporting unit which includes depositing and transporting pulleys each rotated around the rotary axis for pulleys attached to the machine body, at a position tilted at a predetermined angle in relation to the horizontal direction, and an endless depositing and transporting body supported by the depositing and transporting pulleys so as to extend along a first face of the machine body and having projections capable of pushing and transporting coins one by one, and transports the coins fed from the feeding unit;

a recognition unit for at least recognizing denominations of coins transported by the depositing and transporting unit;

a plurality of coin accommodating and ejecting portions which are successively disposed from the front side to the rear side of the machine body, includes accommodating and ejecting belts which are rotated from the first face to the second face of the machine body, and can accommodate coins, which are sorted for each denomination in accordance with a recognition result by the recognition unit on the accommodating and ejecting belts, for each denomination and eject the coins to the second face of the machine body when the accommodating and ejecting belts are rotated;

sorting units which, by electric driving, in accordance with the recognition result by the recognition unit, discharge coins, which are transported by the depositing and transporting unit and cannot be accepted in the machine body, outward from the machine body, and sort coins, which are transported by the depositing and transporting unit and can be accepted in the machine body into the plurality of coin accommodating and ejecting portions for each denomination; and a dispensing and transporting unit which faces the depositing and transporting unit, extends along the second face of the machine body, and transports coins ejected from the coin accommodating and ejecting portions to the coin ejecting port.

2. The coin depositing and dispensing machine according to claim 1, wherein the dispensing and transporting unit includes:

dispensing and transporting pulleys pivotally supported in a horizontal direction in relation to the machine body and rotatable;

an endless dispensing and transporting body which is supported by the dispensing and transporting pulleys and can receive and transport a plurality of coins; and dispensing passage walls surrounding a coin transporting face of the dispensing and transporting body from its both sides and above.

3. The coin depositing and dispensing machine according to claim 2, wherein at least the upper face of each dispensing passage wall is transparent, and an interval between the upper face of the dispensing passage wall and the coin transporting face of the dispensing and transporting body is smaller than the diameter of the smallest coin among coins to be handled by the coin depositing and dispensing machine.

4. The coin depositing and dispensing machine according to claim 2, wherein the upper face of each dispensing passage wall is openable and closable.

5. The coin depositing and dispensing machine according to claim 2, comprising at least one openable and closable door in one of the two side surfaces of each dispensing passage wall and which is facing outward from the machine body.

6. The coin depositing and dispensing machine according to claim 1, further comprising:

a coin discharge port which is disposed at a downstream side in a transporting direction of the dispensing and transporting unit and through which coins transported by the dispensing and transporting unit are discharged outward from the machine body;

a switching gate for switching a transport destination of a coin transported by the dispensing and transporting unit to the coin ejecting port or coin discharge port;

a full state detecting portion for detecting a full state of the coin accommodating and ejecting portions filled with coins; and coin discharge controlling portions for switching a direction of the switching gate to a direction of guiding coins to the coin discharge port side, causing the coin accommodating and ejecting portions, which are detected to be in a full state, to eject the coins, and causing the dispensing and transporting unit to transport the coins, which are ejected from the coin accommodating and ejecting portions, to the coin discharge port in the case where the full state detecting portion detects, in the depositing operation, that the coin accommodating and ejecting portions are filled with coins.

7. The coin depositing and dispensing machine according to claim 6, further comprising a coin cassette which is attachably and detachably disposed under the coin discharge port and accommodates coins transported to the coin discharge port.

8. The coin depositing and dispensing machine according to claim 6, further comprising a collection controlling portion which enables a coin ejecting port or coin discharge port to be selected as transport destinations of all coins in the coin accommodating and ejecting portions when the coins in the coin accommodating and ejecting portions are collected outside the machine body.

9. The coin depositing and dispensing machine according to claim 1, further comprising:

a deposit starting button for starting depositing operation by push-down; and a deposit starting button push-down detecting unit for detecting push-down of the deposit starting button.

10. The coin depositing and dispensing machine according to claim 9, further comprising a deposit controlling portion which drives the feeding unit and depositing and transporting unit to start depositing operation in the case where push-down of the deposit starting button is detected by the deposit starting button push-down detecting unit.

11. The coin depositing and dispensing machine according to claim 9, further comprising:

a temporary storage cover which is disposed between the coin receiving port and feeding unit, can be opened and closed by electric driving and can temporarily store coins received from the outside of the machine body in a closing state;

a temporary storage cover controlling portion which opens the temporary storage cover and drops coins on the temporary storage cover onto the feeding unit in the case where push-down of the deposit starting button is detected by the deposit starting button push-down detecting unit; and a deposit controlling portion which drives the feeding unit and depositing and transporting unit to start depositing operation in the case where push-down of the deposit starting button is detected by the deposit starting button push-down detecting unit.

12. The coin depositing and dispensing machine according to claim 1, further comprising:

a received coin detecting sensor which is disposed on the outer periphery of a lower opening, which is narrower and smaller than an upper opening, of the coin receiving port, and detects receipt of coins in the coin receiving port; and a deposit controlling portion which drives the feeding unit and depositing and transporting unit to start depositing operation in the case where the receipt of coins is detected by the received coin detecting sensor.

* * * * *